US006017578A

United States Patent [19]

Trautmann et al.

[11] Patent Number: 6,017,578

[45] Date of Patent: Jan. 25, 2000

[54] BEAD/CAULKING APPLICATOR WITH FRAME FOLLOWER

[75] Inventors: Hugh M. Trautmann, Renfrew; Leroy F. Rearick, Butler; William H. Dickinson, Zelienople, all of Pa.

[73] Assignee: Billco Manufacturing, Inc., Zelienople, Pa.

[21] Appl. No.: 08/943,664

[22] Filed: Oct. 3, 1997

[51] Int. Cl.[7] ..... B05D 1/00

[52] U.S. Cl. ..... 427/8; 427/207.1; 427/421; 118/668; 118/669; 118/676; 118/712; 118/323

[58] Field of Search ..... 118/668, 669, 118/676, 712, 323; 427/8, 207.1, 421

[56] References Cited

U.S. PATENT DOCUMENTS

| | | | |
|---|---|---|---|
| 4,085,238 | 4/1978 | Chenel et al. | 427/207 |
| 4,546,723 | 10/1985 | Leopold et al. | 118/669 |
| 4,584,964 | 4/1986 | Engel | 118/697 |
| 4,661,368 | 4/1987 | Rohde et al. | 427/8 |
| 5,065,694 | 11/1991 | Earnheart, Jr. | 118/669 |
| 5,215,034 | 6/1993 | Ronsheim | 118/323 |
| 5,344,668 | 9/1994 | Rempe et al. | 427/115 |
| 5,415,693 | 5/1995 | Yoneda et al. | 118/664 |
| 5,431,732 | 7/1995 | Carrell et al. | 118/323 |
| 5,437,727 | 8/1995 | Yoneda et al. | 118/669 |

*Primary Examiner*—Laura Edwards
*Attorney, Agent, or Firm*—Webb Ziesenheim Logsdon Orkin & Hanson, P.C.

[57] ABSTRACT

A bead or caulking material is applied to a workpiece, such as a window frame, utilizing a moveable carriage holding a bead dispensing nozzle thereon. The nozzle is mounted on a platform moveable relative to the carriage. The carriage is moved along a predetermined path relative to the workpiece. Bead or caulking material is simultaneously dispensed from the nozzle onto the workpiece. Additionally throughout the movement of the carriage, the nozzle and platform are biased to maintain engagement between a guide surface mounted on the nozzle and a reference surface. The reference surface may be formed as a portion of the workpiece. The platform may include a pair of orthogonally arranged slides with piston cylinder assemblies utilized for biasing each of the respective slides. Sensors may be provided on each of the cylinders for sensing biasing parameters relating to the biasing of the nozzle and the platform with the sensed parameters utilized for controlling the movement of the carriage.

19 Claims, 4 Drawing Sheets

BEAD/CAULKING APPLICATOR WITH FRAME FOLLOWER

BACKGROUND OF THE INVENTION

1. Field of the Invention

The present invention relates to bead applicating devices for applying a bead or caulking to a workpiece. More specifically, the present invention relates to a bead applicating machine for applying a bead to a deformed workpiece.

2. Description of the Prior Art

Many devices have been developed for applying a bead, caulking material or the like to a workpiece. For example, U.S. Pat. No. 5,344,668 to Rempe et al. discloses a nozzle for applying a fluid material to a work product. The nozzle is controlled by a roller which is adapted to engage the workpiece to guide the nozzle.

U.S. Pat. Nos. 5,415,693 and 5,437,727 both to Yoneda et al. disclose an apparatus for dispensing fluid material onto a substrate according to a predetermined pattern. The applicator includes a nozzle positioned above the substrate mounted on an X-Y positioning table. An optical sensor is positioned adjacent the nozzle to control the process.

U.S. Pat. No. 4,661,368 to Rohde et al. discloses a dispensing nozzle for applying flowable material to a workpiece such as a circuit board. The apparatus provides that the nozzle tip is engaged with the workpiece with the reactive force between the workpiece and the nozzle being sensed to set the appropriate spacing between the nozzle tip and the workpiece.

U.S. Pat. No. 4,584,964 to Engel discloses a programmable machine for depositing viscous material onto a workpiece according to a predetermined pattern. The machine attaches a dispensing nozzle on an X-Y positioning carriage above the workpiece with the carriage being controlled to follow a preprogrammed pattern.

U.S. Pat. No. 4,546,723 to Leopold et al. discloses an apparatus for applying a sealant to insulating glass panel spacer frames. Segments of the frame are advanced longitudinally past a sealant applying station where the sealant is applied appropriately in response to photosensors which determine the presence of the frame.

U.S. Pat. No. 4,085,238 to Chenel et al. discloses an apparatus for applying a plastic film to the edge of a glass workpiece. An extrusion nozzle is positioned above the glass workpiece which is fed past the nozzle by a conveyor. A photoelectric cell senses the edge of the glass workpiece to automate and control the process.

An apparatus in which the dispensing nozzle is positioned on an X-Y-Z positioning carriage to follow a preprogrammed pattern, such as described in some of the prior art patents discussed above, represents one of the most common types of bead applicating devices. Problems can arise in these systems if the workpiece does not conform precisely to the idealized workpiece intended when developing the predetermined pattern for the carriage. In the application of bead or caulking to a window frame, a bent or distorted frame member will often result in a misapplied bead.

It is an object of the present invention to overcome the drawbacks of the above-described prior art. It is a further object of the present invention to provide a nozzle apparatus which can follow a deformed or distorted workpiece. It is a further object of the present invention to provide a nozzle apparatus which can be retrofitted to existing bead applicating devices. It is a further object of the present invention to provide a bead applicating machine which is easily constructed and simple to use. It is a further object of the present invention to provide a method of applying a bead to a workpiece which accommodates distortions in the workpiece.

SUMMARY OF THE INVENTION

The objects of the present invention can be achieved by utilizing a nozzle assembly for a bead applicating machine according to the present invention. The nozzle assembly of the present invention includes a base member that can be attached to a moveable carriage assembly with a first slide mounted on the base. A biasing mechanism is coupled to the first slide for biasing the slide in at least one direction. A second slide is mounted on the first slide with the second slide orientated substantially perpendicular to the first slide. A biasing mechanism is coupled to the second slide for biasing the second slide in at least one direction. A nozzle mounted on the second slide, with the nozzle adapted to be connected to a source of supplied material which forms the bead. A guide member is mounted on the nozzle and adapted to be engagable with a reference surface for proper positioning of the nozzle.

In one embodiment of the present invention, each biasing mechanism can be formed as an air piston cylinder assembly with one piston cylinder assembly attached to the base member and the other piston cylinder assembly attached to the first slide. Each piston cylinder assembly may further include a sensor coupled thereto, with each sensor adapted to be coupled to a central controller for the carriage. Each sensor may be utilized to sense the appropriate biasing parameters used for controlling the movement of the carriage.

One embodiment of the present invention provides that the guide member is a roller rotationally mounted on the nozzle adjacent the distal end of the nozzle such that the reference surface can be formed as a portion of the workpiece. In particular, where the workpiece is a frame member, the reference surface may be an upwardly extending portion of the frame.

Another aspect of the present invention is the formation of a bead applicating machine incorporating the nozzle assembly of the present invention. In addition to the nozzle assembly, the bead applicating machine of the present invention includes a workpiece supporting table and the carriage mounted above the table with the nozzle assembly mounted on the moveable carriage. The carriage may be mounted on the X-Y-Z positioning system above the table with a central controller coupled to the carriage controlling the movement of the carriage.

The present invention provides a method for applying a bead, caulking or the like to a workpiece utilizing a moveable carriage holding a dispensing nozzle thereon which is mounted on a platform moveable with relation to the carriage. The method according to the present invention includes the steps of moving the carriage along the workpiece generally along a predetermined path simultaneously dispensing bead material from the nozzle onto the workpiece, and simultaneously biasing the nozzle and platform to maintain an engagement between a guide surface of the nozzle and a reference surface. The workpiece may be formed at the frame member with the reference surface as part of the workpiece. The methods of the present invention may further include the steps of sensing biasing parameters relating to the biasing of the nozzle and the platform and controlling the movements of the carriage based upon the sensed biasing parameters.

These and other advantages of the present invention will be clarified in the Detailed Description of the Preferred Embodiments, taken together with the attached figures, wherein like reference numerals represent like elements throughout.

DETAILED DESCRIPTION OF THE PREFERRED EMBODIMENTS

Figure 1:
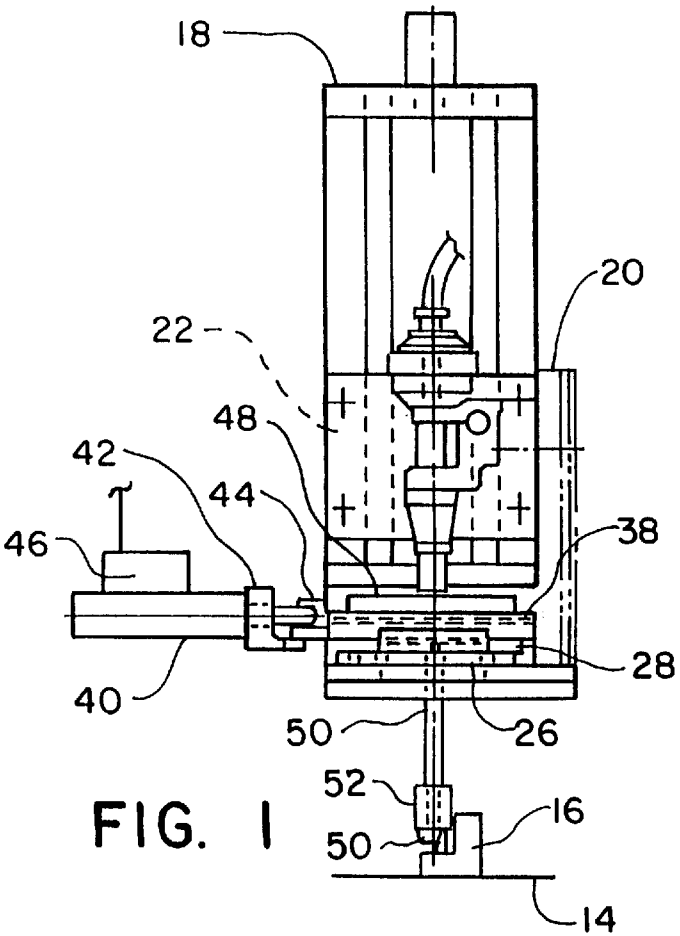
FIG. 1 is a front view of a portion of a nozzle assembly of a bead applicating machine according to the present invention.
Figure 3:
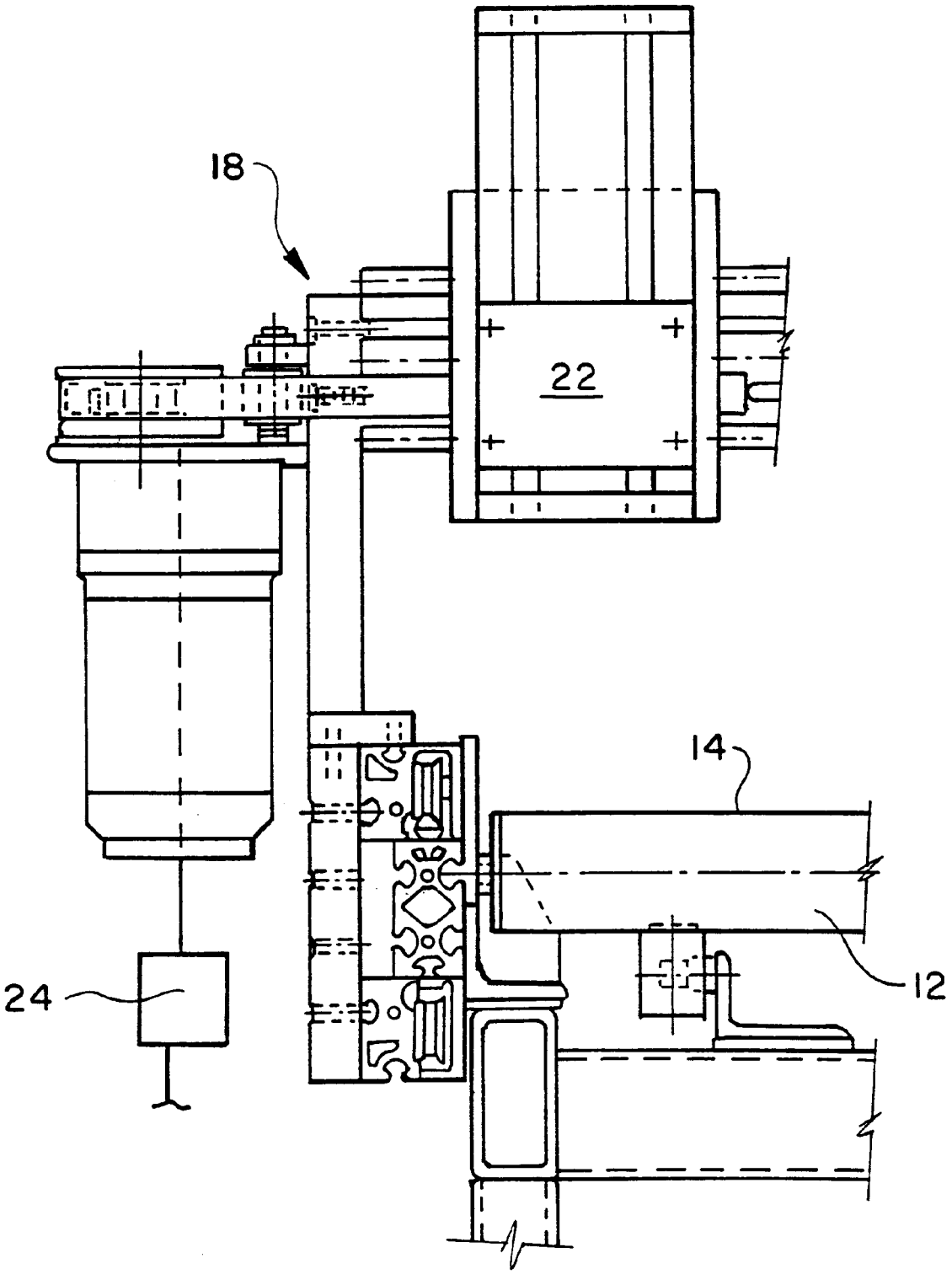
FIG. 3 is a front view of a portion of the bead applicating machine according to the present invention.

Various components of a bead applicating machine according to the present invention are illustrated throughout the figures. The bead applicating machine according to the present invention includes a workpiece supporting table 12, a portion of which is shown in FIG. 3. An upper work surface 14 of the workpiece supporting table 12 supports a workpiece 16 (which is illustrated in FIG. 1) which may be a window frame or the like. The workpiece supporting table 12 may be formed of a plurality of workpiece transporting rolls, some of which are driven or may be formed in any other fashion.

An X-Y-Z positioning system 18 is attached to the table 12 as shown in FIG. 3. The X-Y-Z positioning system 18 supports a carriage 20 which is attached to a carriage mounting bracket 22 as shown in FIG. 3. The X-Y-Z positioning system 18 is controlled by a conventional central controller 24 shown schematically in the figures. The X-Y-Z positioning system 18 essentially comprises three orthogonally arranged slide members with separate controls driving each slide. The movement and operation of X-Y-Z positioning system 8, itself, which is conventional and well known in the art.

Figure 2:
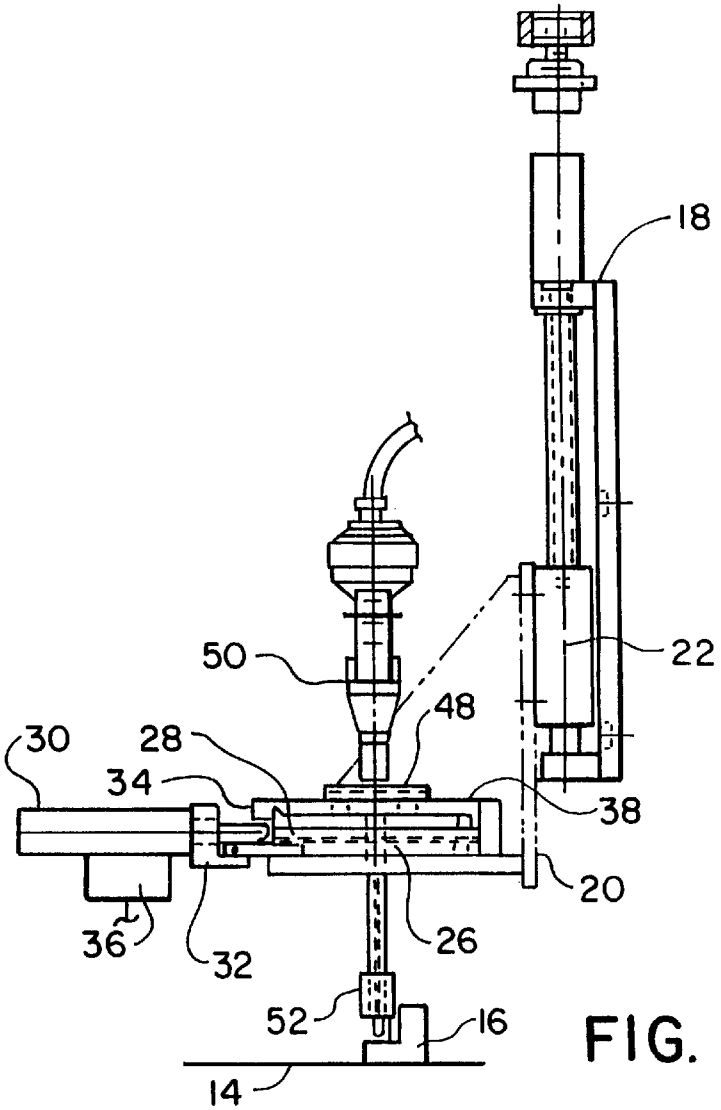
FIG. 2 is a side view of the nozzle assembly illustrated in FIG. 1.

The carriage 20 is essentially formed as an L-shaped bracket as illustrated in FIGS. 1 and 2. The carriage 20 is connected to a base member 26 of the nozzle mounting assembly.

Figure 4:
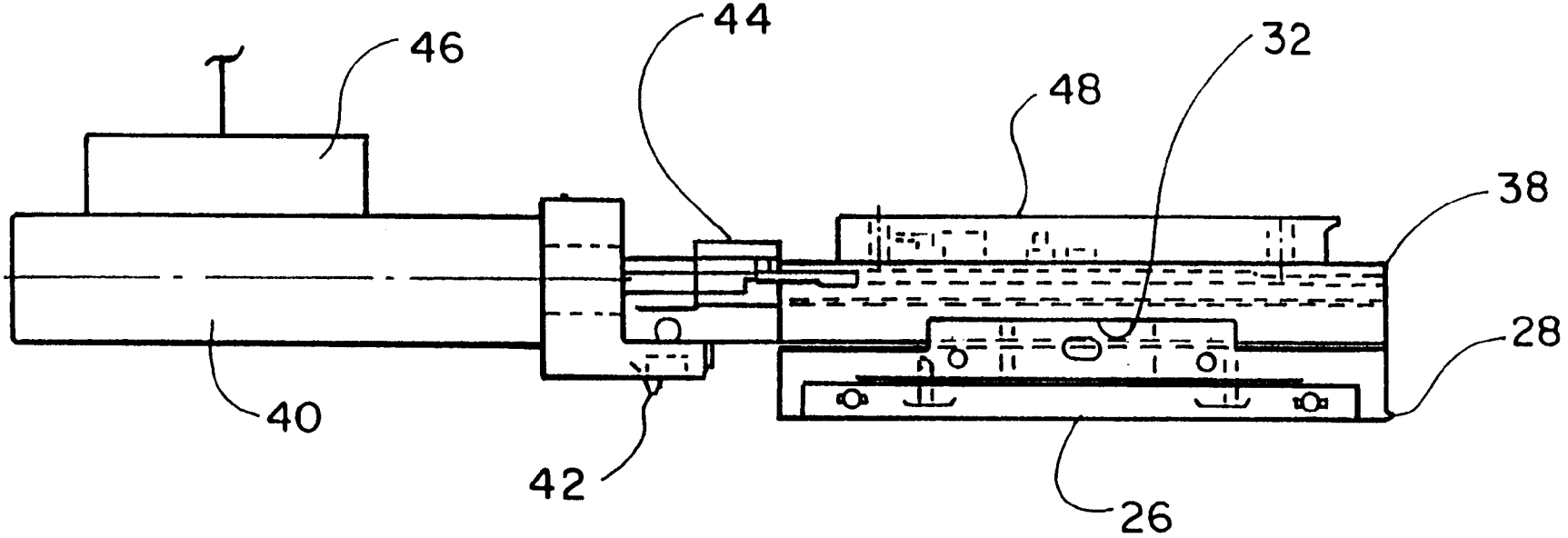
FIG. 4 is an enlarged side view of a platform assembly portion of the nozzle assembly illustrated in FIG. 1.
Figure 5:
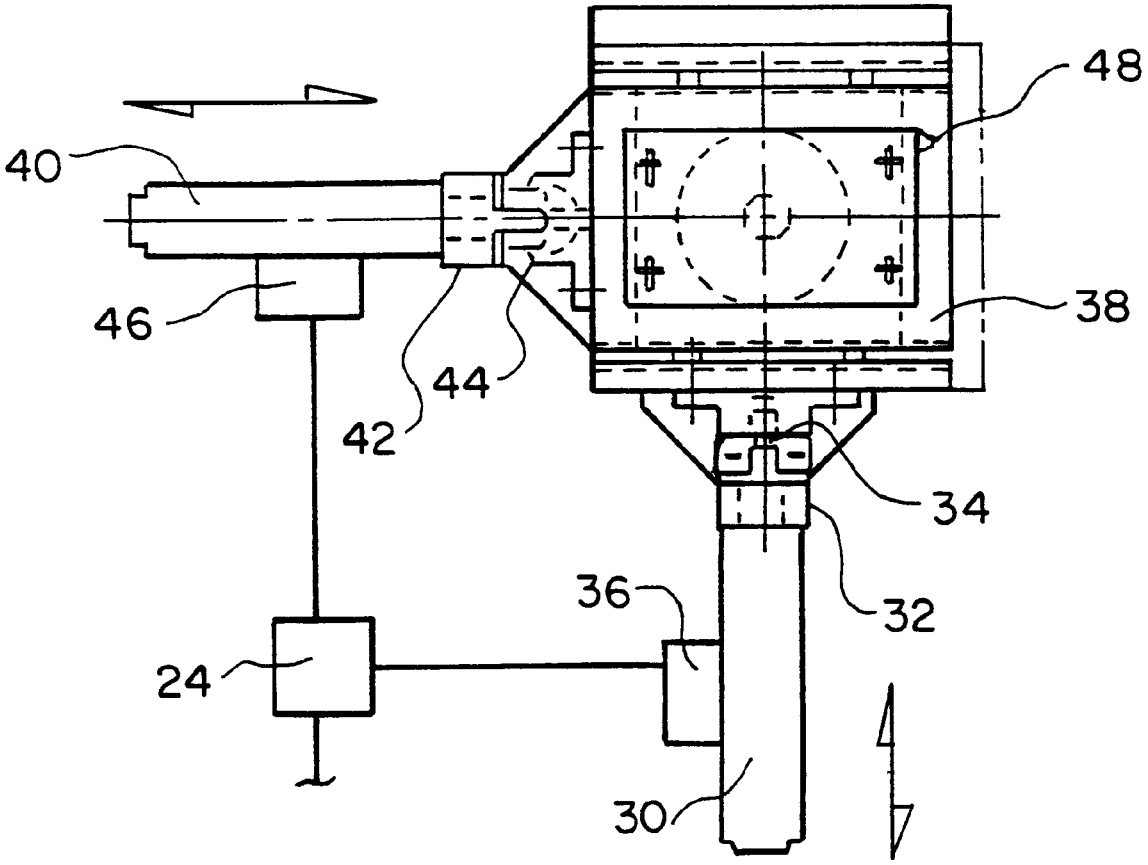
FIG. 5 is a plan view of the platform assembly illustrated in FIG. 4.

On top of the base member 26 is a first slide 28 as better illustrated in FIGS. 4 and 5. The first slide 28 is mounted for movement essentially perpendicular to the views illustrated in FIGS. 1 and 4. A first piston cylinder assembly 30 is attached to the base member 26 through cylinder mount 32 and coupled to the first slide 28 through link 34. With regard to FIGS. 1 and 4, the piston cylinder assembly 30 is removed from these figures for clarity. The piston cylinder assembly 30 is utilized for moving and/or biasing the first slide 28 in either desired direction in which the first slide 28 can move relative to the base member 26. Piston and cylinder 30 includes a sensor 36. The sensor 36 may be utilized to sense the pressure or position of the piston cylinder assembly 30.

A second slide 38 is mounted on the first slide 28 in a direction of movement essentially perpendicular to the movement of the first slide 28. The second slide 38 is moveable by a piston cylinder assembly 40. A cylinder mount 42 attached to the first slide 28 is coupled to the cylinder of the piston cylinder assembly 40. The piston cylinder assembly 40 is coupled to the second slide 38 through link 44. The piston cylinder assembly 40 is utilized for movement of the second slide 38 and for biasing of the second slide 38 in the appropriate direction. The piston cylinder assembly 40 includes a sensor 46 which is essentially the same as sensor 36 described above. Both cylinders can easily be used to form each piston and cylinder assemblies 30 and 40 discussed above.

A nozzle mounting plate 48 is attached to the top of the second slide 38. An extended nozzle 50 is attached to the mounting nozzle plate 48 and extends through central apertures in the nozzle mounting plate 48 as well as the various slide mechanisms as illustrated in FIGS. 1 and 2. The apertures through the nozzle mounting plate 48 and other elements are best illustrated in FIG. 5. The nozzle 50 includes a dispersion tip at a distal end thereof, adjacent the workpiece 16 and is adapted to be coupled to a source of supplied material (not shown) in a conventional fashion, the supplied material is utilized to form the bead, caulking or the like on the workpiece. The nozzle 50 additionally includes a roller 52 rotatively positioned near the distal end of the nozzle 50 and is adapted to engage a reference surface for proper positioning of the dispersion tip at the distal end of the nozzle 50 as will be described hereinafter.

The bead applicating machine operates as follows. The workpiece 16, such as the frame of a window, is positioned on the upper work surface 14 on the workpiece support table 12 in the desired start location in a conventional fashion. The X-Y-Z positioning system 18 will move the carriage 20 along a predetermined pattern for application of a bead, caulking or other material to the workpiece 16. Each of the piston cylinder assemblies 30 and 40 is utilized to bias the first slide 28 and second slide 38 in an appropriate direction to maintain the roller 52 against a reference surface. With a frame forming workpiece 16, the reference surface may be an upwardly extending portion of the frame as illustrated in FIG. 1. The engagement of the roller 52 against the reference surface will properly position the nozzle 50 relative to the workpiece as the carriage 20 moves along the predetermined path. A variation or deformation in the workpiece 16 will result in the roller 52 following the variation in the workpiece 16 such that the bead follows minor deviations in the workpiece 16. This is a result of the ability of the platform assembly formed by the first slide 28 and second slide 38 to move relative to the carriage 20, essentially providing for a floating nozzle 50 which can accommodate workpiece variations. When the X-Y-Z positioning system 18 has completed the predetermined pattern, the bead applicating machine of the present invention will have applied a uniform bead, caulking or the like on the workpiece following the deviations or variations in the specific workpiece.

The present invention additionally contemplates utilizing feedback from sensors 36 and 46 to control the X-Y-Z positioning system 18 through central controller 24. For example, if the nozzle 50 or the roller 52 engages with a corner portion of the workpiece 16, or it completely disengages from the workpiece 16, this event will be sensed by the appropriate sensors 36 or 46 and this information may be sent to the central controller 24. The central controller 24 can utilize this information to modify the movement of the X-Y-Z positioning system 18 accordingly. For example, if the workpiece 16 is a rectangular frame, the carriage 20 and nozzle 50 can begin at a starting corner on the frame and extend along one edge until the appropriate sensors 36 or 46 determines that the nozzle 50 is engaged with a perpendicular side. Once the central controller 24 receives the appropriate information from one of these sensors 36 or 46, the X-Y-Z positioning system 18 can be instructed by the central controller 24 to move along the next side of the frame or workpiece 16. The process may be repeated until all four sides of the workpiece 16 is done. This illustration is only an example of the possible uses of sensors 36 and 46 in the bead applicating machine of the present invention. Appropriate optical sensors may be mounted on the carriage 20, or other components, and coupled to the central controller 24. Optical sensors can be used to sense the edge of the workpiece to control the operation of the X-Y-Z positioning system (e.g. when the edge of the workpiece is sensed by an optical sensor, the next beading sequence can begin). The bead applicating machine of the present invention can be utilized for applying beads, caulkings or any other type of fluid material. The nozzle assembly for the bead applicating machine of the present invention is specifically designed to be retrofitted into existing bead applicating machines. This retrofitting will allow existing machines to easily accommodate distorted workpieces in the manner discussed above.

It will be apparent to those of ordinary skill in the art that various modifications may be made to the present invention without departing from the spirit and scope thereof. The scope of the present invention is to be defined by the appended claims and equivalents thereto.

What is claimed is:

1. A nozzle assembly for a bead applicating machine, said nozzle assembly comprising:

a base member attached to a moveable carriage assembly;

a first slide mounted on said base member;

a biasing mechanism coupled to said first slide for biasing said slide at least in one direction;

a second slide mounted on said first slide, said second slide orientated substantially perpendicular to said first slide;

a biasing mechanism coupled to said second slide for biasing said second slide in at least one direction;

a nozzle mounted on said second slide, said nozzle connected to a source of supplied material, said nozzle having a longitudinal axis which is substantially perpendicular to said first slide and said second slide; and a guide member mounted on said nozzle engagable with a reference surface of the workpiece for proper positioning of said nozzle.

2. The nozzle assembly of claim 1, wherein each said biasing mechanism is a piston cylinder assembly.

3. The nozzle assembly of claim 2, wherein one said piston cylinder assembly is attached to said base member and another said piston cylinder assembly is attached to said first slide.

4. The nozzle assembly of claim 1, wherein said guide member is a roller mounted on said nozzle.

5. The nozzle assembly of claim 4, wherein said roller is rotationally mounted adjacent a distal end of said nozzle.

6. The nozzle assembly of claim 1, further including at least one sensor adapted to sense a workpiece edge, each said sensor adapted to be coupled to a central controller for the carriage.

7. A bead applicating machine for applying a bead to a workpiece, said machine comprising;

a workpiece supporting table;

a moveable carriage mounted above said table; and a nozzle assembly mounted on said carriage, said nozzle assembly including (i) a base member attached to said carriage, (ii) a pair of slides mounted on said base member, (iii) a means for biasing each said slide in at least one direction, and (iv) a bead dispensing nozzle mounted on one of said slides, said nozzle connected to a source of supplied material, said nozzle having a longitudinal axis which is substantially perpendicular to said pair of slides.

8. The bead applicating machine of claim 7, wherein said nozzle assembly also includes a guide member mounted on said nozzle and engagable with a reference surface of the workpiece for proper positioning of said nozzle.

9. The bead applicating machine of claim 8, wherein said guide member is a roller mounted on said nozzle.

10. The bead applicating machine of claim 9, wherein said roller is rotationally mounted adjacent to a distal end of said nozzle.

11. The bead applicating machine of claim 8, wherein said biasing means includes a cylinder assembly coupled to each said slide.

12. The bead applicating machine of claim 11, further including a central controller coupled to said carriage for controlling movement of said carriage.

13. The bead applicating machine of claim 12, wherein each of said piston cylinder assembly is an air piston cylinder assembly and includes a sensor coupled thereto, each said sensor coupled to said central controller.

14. The bead applicating machine of claim 7, wherein said biasing means includes an air piston cylinder assembly attached to each said slide.

15. The bead applicating machine of claim 14, further including a central controller mount of said carriage.

16. The bead applicating machine of claim 15, wherein said carriage is mounted on an X-Y-Z positioning system above said table.

17. The bead applicating machine of claim 16, wherein each of said piston cylinder assembly includes a sensor coupled thereto, each said sensor coupled to said central controller.

18. A method of applying a bead to a frame member utilizing a moveable carriage holding a bead dispensing nozzle thereon which is mounted on a platform moveable relative to the carriage, said method comprising the steps of:

moving the carriage along the frame member;

simultaneously dispensing the material from the nozzle onto the frame member; and simultaneously biasing the nozzle and the platform to maintain an engagement between a guide surface mounted on said nozzle and a reference surface of the frame member wherein said nozzle is biased in two directions each said direction being perpendicular to each other and perpendicular to a longitudinal axis of said nozzle.

19. The method of claim 18, further including the steps of:

sensing biasing parameters relating to the biasing of the nozzle and the platform; and controlling the movement of the carriage based upon the sensed biasing parameters.

* * * * *